US005193238A

United States Patent [19]

Clute

[11] Patent Number: 5,193,238

[45] Date of Patent: Mar. 16, 1993

[54] INFANT SUPPORT PILLOW

[76] Inventor: L. Jason Clute, 3401 Deer Ridge Dr., Danville, Calif. 94506-6047

[21] Appl. No.: 934,256

[22] Filed: Aug. 25, 1992

[51] Int. Cl.[5] ..... A47C 20/02

[52] U.S. Cl. ..... 5/655; 5/657; 5/630; 5/490; 5/465

[58] Field of Search ..... 5/630–632, 5/652, 655, 657, 465, 490

[56] References Cited

U.S. PATENT DOCUMENTS

| | | | |
|---|---|---|---|
| 2,562,725 | 7/1951 | Leto et al. | 5/930 X |
| 3,241,161 | 3/1966 | Dashosh | 5/490 X |
| 3,389,411 | 6/1968 | Emery | 5/490 |
| 3,942,282 | 12/1975 | Bond | 5/632 |
| 4,397,052 | 8/1983 | Lund, III | 5/930 X |
| 4,506,376 | 3/1985 | Ritchie, Jr. et al. | 5/657 X |

FOREIGN PATENT DOCUMENTS

| | | | |
|---|---|---|---|
| 1449012 | 7/1966 | France | 5/655 |

*Primary Examiner*—Michael F. Trettel

[57] ABSTRACT

A support pillow in two detachable main sections, each section having an elongated right triangular wedge-shaped resilient foam member each covered with fabric with a portion of the fabric extending outward to define a flexible rectangular panel. The top surface of one rectangular panel, and the bottom surface of the other rectangular panel are affixed with elongated hook and loop fastening strips which allow adjustable overlapping affixment of the two rectangular panels one to another, thereby allowing affixing together of the two main sections of the pillow. When affixed together, the two sections of the support pillow define an open-ended and open-top channel with the rectangular panels and fabric covered foam members providing a roll-preventing flat bottom, and the fabric covered foam members additionally defining two spaced apart vertically oriented side walls of the channel. The hook and loop attachment of the two rectangular panels provides for adjustability in the distance between vertical side walls of the channel. An infant may be placed on its side, on top of the overlapped rectangular panels with the vertical side walls of the support pillow positioned snugly against the chest and back of the infant, with the infant's torso within the channel. The infant's head extends out one open end of the channel, and his legs extend out the outer oppositely disposed open end of the channel. The support pillow assists in stabilizing and maintaining the infant comfortably in a lateral sleeping position.

5 Claims, 4 Drawing Sheets

INFANT SUPPORT PILLOW

BACKGROUND OF THE INVENTION

1. Field of the Invention

The present invention relates to support pillows for humans in general, and in particular to an adjustable pillow which supports and maintains the torso of an infant generally stationary while sleeping.

2. Description of the Prior Art

There have been studies in the past which provide some evidence that supporting infants in certain positions during sleep may help to prevent the occurrence of Sudden Infant Death Syndrome, commonly referred to as SIDS. Some of the most recent information indicates that positioning the infant in a lateral position (on its side) during sleep may be the most desirable and helpful position in reducing the occurrence of SIDS. At this time there is no definitive diagnosis of the cause of SIDS, and it remains a serious problem with no known cure. Some theorize the infants simply suffocate possibly due to their not having enough strength to raise their heads off the mattress when in a prone position in order to avoid whatever obstacle is blocking their breathing. SIDS is more prevalent in the first six months of the infant's life, which adds support to the theory that the infant's underdeveloped motor skills may be a factor in SIDS deaths. Some believe placing infants on their backs can also be dangerous if they regurgitate formula and subsequently aspirate it into their lungs.

In the past, some parents have positioned infants on their sides with the use of bed pillows or rolled blankets propped against the back and or front of the infant, primarily for the purpose of allowing the infant to nurse from a bottle more easily. However, bed pillows and rolled blankets tend to become easily dislodged as the infant moves about, and are generally ineffective in maintaining the infant in a true lateral position. The dislodged bed pillows and blankets also pose the potential danger of covering the infant's face and interfering with its breathing.

While there have in the past been child support pillows provided for supporting an infant on its back in a semi-lateral position, normally there is no frontal support to prevent the child from rolling over onto its stomach. Other existing non-adjustable support pillows which have two lateral sides would, if they were structured to retain infants, also only maintain them in a semi-lateral position, or allow the baby to roll due to the lack of a sufficiently flat and wide bottom surface on the pillow. None of the existing support pillows are properly adjustable to accommodate the various sizes of infants, or are readily portable or machine washable. Therefore there is a significant need for a suitably structured support pillow for use with infants which may reduce the occurrence of SIDS.

SUMMARY OF THE INVENTION

The present invention is an adjustable support pillow primarily for use with infants, to maintain an infant on its side during sleep and thus hopefully reduce the risk of SIDS, while also providing an acceptable level of comfort. My support pillow includes two detachable main sections. Each main section is structured of an elongated wedge-shaped resilient padding member each covered with a flexible thin sheeting material to define right-triangular pads. The thin sheeting material may be a soft fabric or the like which is washable, or may be thin sheeting material which is disposable, such as the fiber filled paper-like materials such as those often used in hospitals for disposable gowns. I have also considered using plastic sheeting. The thin sheeting material of each triangular pad extends from and beyond one lateral edge thereof to define a thin flexible rectangular panel. The two main sections of the pillow are adjustably affixable together along the rectangular panel portions with the use of attached elongated strips of hook and loop fasteners utilized to connect the two rectangular panels when overlapping one another. When affixed together, the two main sections of the support pillow define an open-ended and open-top channel with the rectangular panels and flat bases of the triangular pads defining a flat bottom to prevent the pillow and baby from rolling on a surface, and with the triangular pads additionally defining two spaced apart vertically oriented side walls of the channel. An infant may be placed on its side, on top of the overlapped rectangular panels which define the bottom of the channel, with the vertical side walls of the support pillow positioned snugly against the chest and back of the infant, with the infant's torso within the channel. The infant's head extends out one open end of the channel, and his legs extend out the other oppositely disposed open end of the channel. The hook and loop fasteners on the overlapped panels allow the distance between two parallel lateral vertical sides of the triangular pads to be adjusted in spacing by adjusting the overlap of the two rectangular panels, and thus adjusting the width of the channel, with this being to accommodate for varying widths of infants, and for gradual increases as an infant grows. The hook and loop fasteners which affix the two main sections together allow for very small increment adjustments in the width of the channel, and therefore are preferred to a series of snaps or buttons which might also work.

Although the size of my support pillow in a small size for infants is adjustable to accommodate just about any size of infant, my support pillow could conceivably be manufactured of a size suitable for adults such as those under convalescent care. The major emphasis on the use of my support pillow is however during the first three to six months of life when the infant's motor skills are at their weakest, and it is therefore primarily sized for newborns.

The preferred structure for providing proper body alignment for the infant includes the longitudinal length of the pillow extending from the infant's shoulders to its buttocks, and the pad extending in height to just below or level with the infant's shoulder while laying on its side. The structural composition of the support pillow, and specifically the pads, is developed to be soft and resilient for comfort, yet rigid enough to provide support when properly adjusted to fit snugly against the baby. The support pillow is also structured to allow free movement of the infant's legs, when desired, allowing the baby to lay in a fetal or semi-fetal position.

Although newborn infants do not have the strength and dexterity to significantly reposition themselves, they do at times seem to be able to scoot about for short distances. Primarily this minor scooting movement is created by the random kicking of their legs, which tends to push them upwards. Although there is little danger of the infants scooting downward into the support pillow, precautions have still been taken to avoid this occurrence since their breathing could be hampered if their faces were pressed against the vertical side wall of the pad. One element of the invention aimed towards preventing downward slippage of the infant is the addition of a strap which is placed over the infant's side, securing him in position within the support pillow. The strap includes connectors which allow for adjustable tensioning over the baby. In addition, the thin sheet covering of the pillow is preferably manufactured of a non-slick fabric material which will provide frictional adhesion against the infant's clothing in the area of the channel, and frictional adhesion between the flat bottom of the support pad and whatever surface the support pillow is placed upon. Terry-cloth has been found to function well as a thin sheeting material which is washable. It is also suggested for the excessively active newborn that the infant's torso be wrapped or swaddled in a receiving blanket to avoid major leg movement. Swaddling newborn infants is a well known and widely accepted procedure practiced in many hospitals today. It has been found to be calming to them, presumably since it may resemble the infant's condition prior to birth and therefore makes them feel more secure. With my support pillow, because it is sufficiently short to leave the legs free, an infant can still bend its legs somewhat while in the support pillow, thereby being more comfortable.

My support pillow is structured for convenient use, being small enough to be easily portable within a conventional diaper bag and also easy to keep clean. These are significant features since traveling with a child already involves transporting a large variety of articles, and being able to carry the support pillow within a diaper bag is a major convenience. The overall small size of the pillow is important in that it can be easily used within cribs, cradles and even infant carriers. The washability of the support pillow, or ease of replacing and or washing soiled parts thereof, is also a concern addressed with my invention, since items coming in close contact with the child can often become soiled, it is important that they be quickly and easily cleaned to avoid infecting the child. Since the support pillow may be manufactured of conventional material, it can be easily provided in a variety of decorative colors and patterns to coordinate with the child's room decor, which would more than likely be a significantly important feature to the mother of the child. The general low cost of materials of which the invention may be manufactured, and the ease of assembly, should enable my support pillow to be provided at a relatively low price to the consumer.

DESCRIPTION OF A PREFERRED EMBODIMENT

Figure 1:
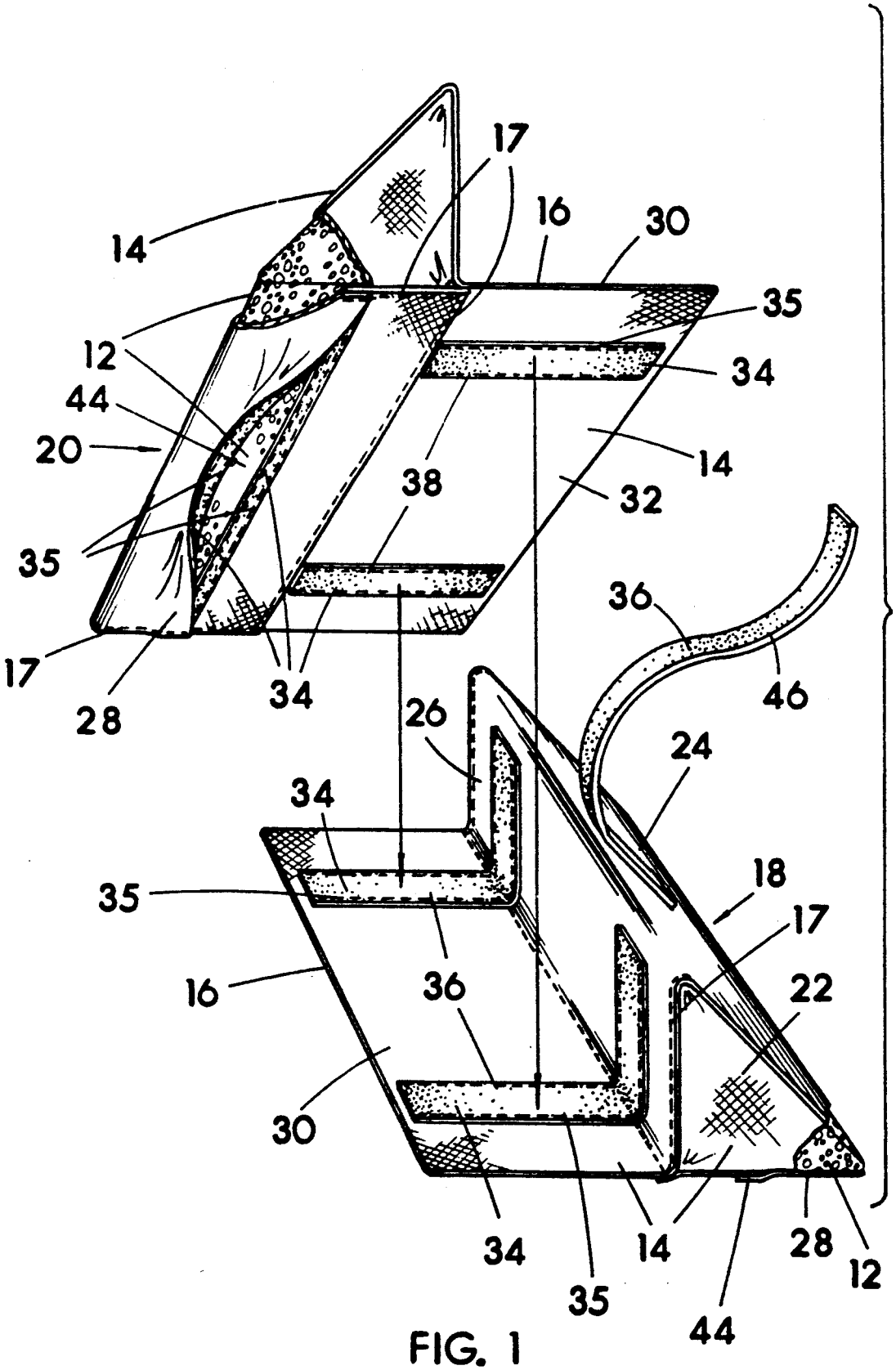
FIG. 1 is an exploded perspective view of the two detachable main sections of a preferred embodiment of my support pillow.
Figure 2:
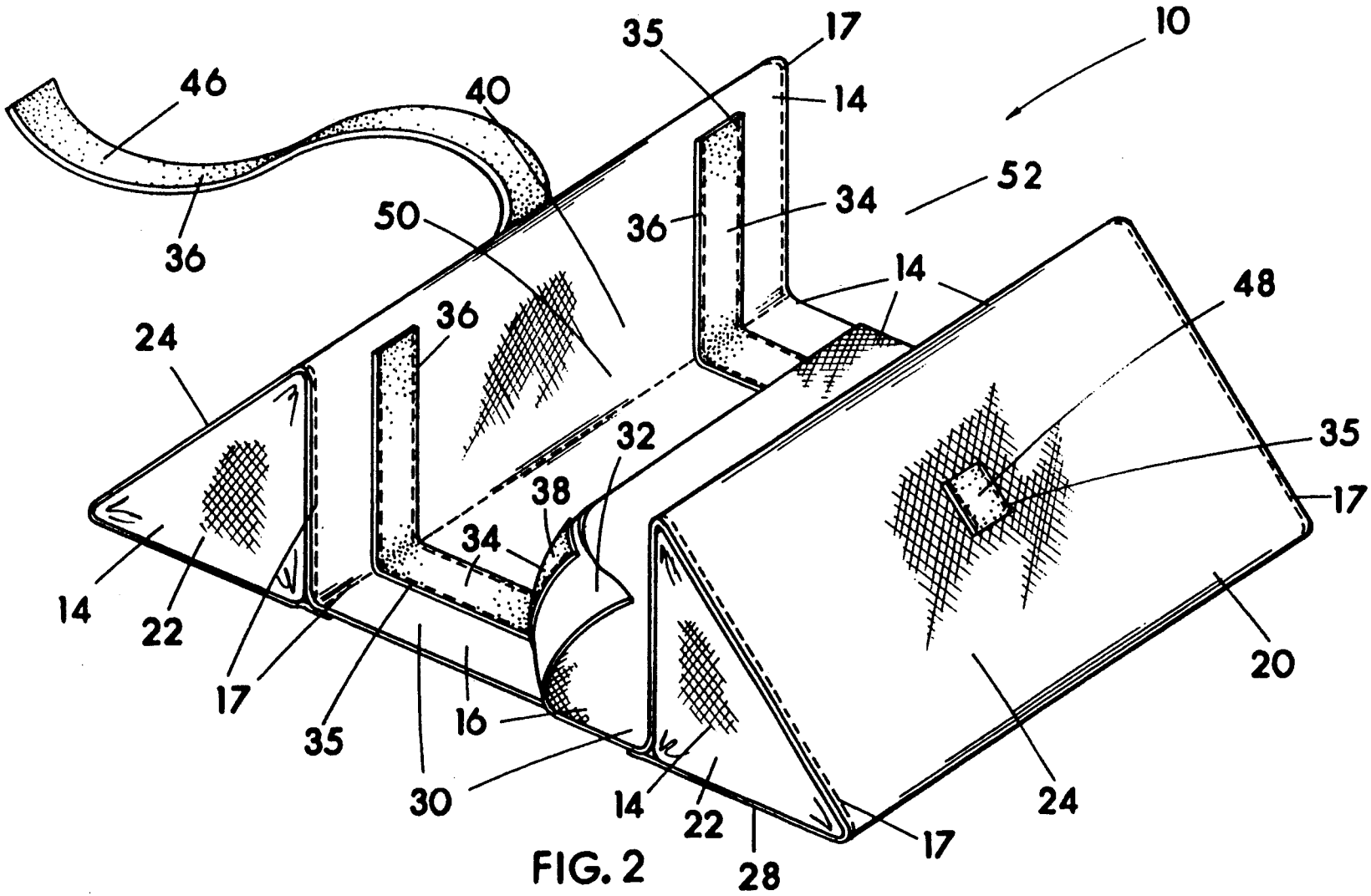
FIG. 2 is a top perspective view of the preferred embodiment of my support pillow of FIG. 1 with both main sections attached to one another.
Figure 3:
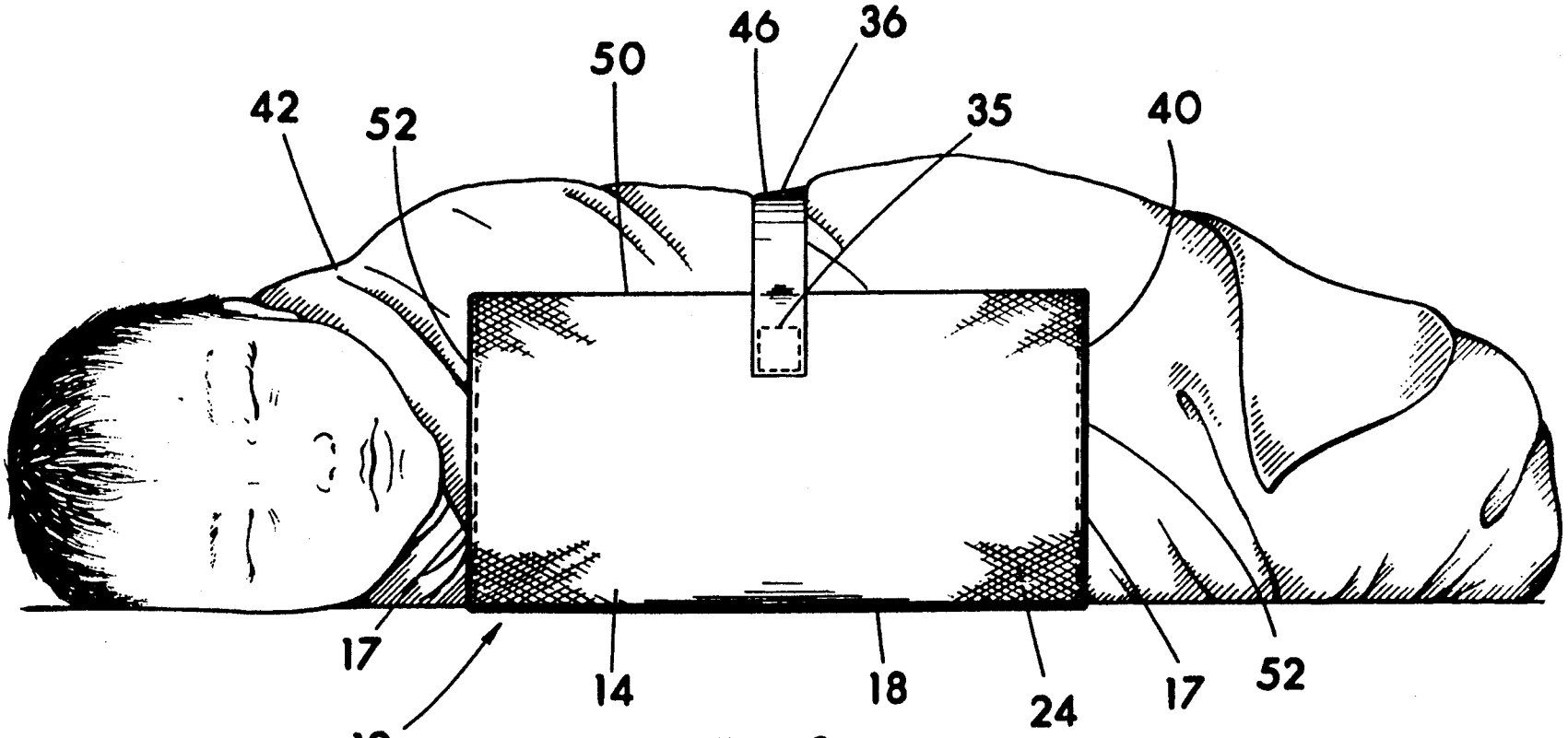
FIG. 3 is a side view of my preferred embodiment of support pillow of FIG. 1, shown in-use supporting an infant on its right side.
Figure 4:
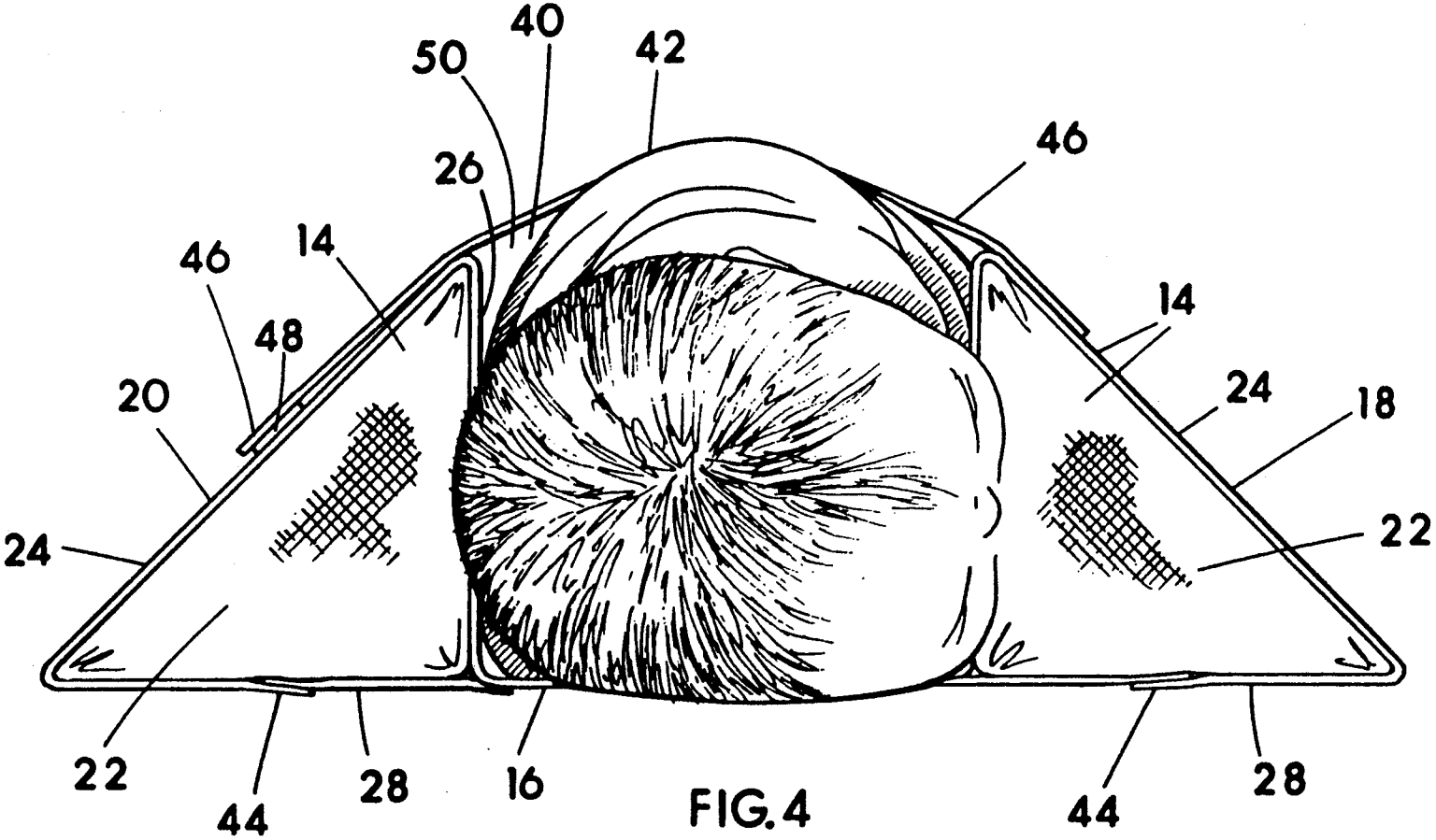
FIG. 4 is an in-use end view of my preferred embodiment of support pillow of Figs. 1 and 2, showing the head and shoulders of the infant with the chest and back of the infant supported by the vertical side walls.

Referring to the drawing FIGS. 1 through 4 where a preferred embodiment of my support pillow 10 is illustrated for example. Support pillow 10 is structured of two adjustably affixed main sections 18 and 20 which are detachable from one another, each of which include two elongated triangular resilient foam members 12 which form right triangles when viewed endwardly. Foam members 12 are made of what is commonly referred to as foam rubber which in most cases is a foamed synthetic plastic which remains flexible and resilient. Although foam members 12 could also be other shapes, such as an elongated rectangle, the triangular shape reduces the bulk and amount of foam and materials required to manufacture support pillow 10. The triangular foam members 12 could be made of a variety of flexible and resilient materials including cotton or fiber batting or any suitably soft and resilient material which is sufficiently rigid to provide support. Both foam members 12 each have an outer layer or wrapping of thin flexible sheeting, or fabric covering 14, which extends over the lateral surfaces of foam member 12 and also extends outward from the right angled corner of foam member 12 to form rectangular panel 16. Fabric covering 14 also covers both ends of foam members 12, and is affixed in position with conventional methods such as sewing or adhesives, although the creation of permanently sewn seams 17 is preferred. Fabric covering 14 preferably consists of a loose weave material such as terry-cloth which provides a non-slip surface and is somewhat absorbent to prevent moisture condensation when it comes in contact with the skin.

The two assembled main sections of support pillow 10, main section 18 and main section 20, are each structured with two parallel vertical end walls 22, an angled lateral side wall 24, a lateral vertical side wall 26 connected to a flat longitudinal horizontal base 28. Rectangular panel 16 extends from and beyond the intersection of lateral vertical side wall 26 and longitudinal horizontal base 28, and rectangular panel 16 lays in the same basic plane as the flat bottom of longitudinal horizontal base 28. Lateral vertical side wall 26 is connected to longitudinal horizontal base 28 at ideally a 90 degree angle or vertical to the horizontal base 26, but I have had relatively good results with lateral vertical side wall 28 laying anywhere in between 75 and 105 degrees relative to the horizontal base 28. Rectangular panel 16 has a top surface 30 which primarily faces upward in use, and an oppositely disposed bottom surface 32 which faces downward and rests on a supporting surface, such as a bed.

Both main sections 18 and 20 are releasably and adjustably affixed together with the use of two elongated hook and loop fastening strips 34. Each hook and loop fastening strip 34 includes two mating strips; one a softer looped section 36 and the other a coarser hooked section 38, the two of which releasably adhere to one another when pressed together. The two softer looped sections 36 of hook and loop fastening strips 34 are affixed transversely onto top surface 30 of panel 16 and onto lateral vertical side wall 26 of main section 18, one affixed near each end wall 22. Each looped section 36 runs transversely from adjacent the lateral distal edge of panel 16 of main section 18 to adjacent the top lateral edge of vertical side wall 26. The two coarser hooked sections 38 of hook and loop fastening strips 34 are affixed transversely to bottom surface 32 of panel 16 of main section 20, one near each end wall 22, and are longitudinally aligned with both looped sections 36 affixed to main section 18. Hook and loop fastening strips 34 are preferably affixed to support pillow 10 using the conventional method of stitching 35, although other suitable methods such as adhesives can also be used. The hook and loop fasteners of the rectangular panels 16 of the main sections 18 and 20 are positioned and sized relative to one another and relative to the vertically disposed side walls 26 so as to allow for small increment adjustments in the spacing between the vertically disposed side walls 26 and thus in the width of the channel 40.

Affixed to the angled side wall 24 of main section 18 is an adjustable attachment strap 46. Attachment strap 46 is preferably structured of an elongated section of the looped section 36 of hook and loop fastening strips 34. Strap 46 is endwardly affixed, preferably with stitching 35, to the central surface of angled side wall 24 of main section 20, with the soft looped surface facing downward. The distal end of strap 46 is then affixed to strap connector 48 which is structured of a short rectangular section of hooked section 38 of hook and loop fastening strips 34. Strap connector 48 is similarly affixed with stitching 35 to the central surface of angled side wall 24 of main section 18. Since strap 46 is structured entirely of looped section 36, it can be attached anywhere along its length to strap connector 48 thereby being adjustable to accommodate a variety of sizes of infants 42.

The assembled support pillow 10 can be machine washed and dried as a unit, or if desired, foam members 12 can be removed from fabric covering 14 through pocket opening 44. Pocket opening 44 is located on the central surface of horizontal base 28 of both main sections 18 and 20. Pocket opening 44 runs lengthwise between both end walls 22 and is closable with hook and loop fastening strips 34, although other suitable attachments such as zippers can be used, or even just overlapped fabric without a fastener might work. Since fabric covering 14 forms the edges of pocket opening 44, pocket opening 44 can be stretched apart, due to the inherent flexible nature of fabric covering 14, to allow the removal of foam member 12. Foam members 12 are also malleable and can be easily manually compressed for insertion and removal from pocket opening 44.

To affix both main sections 18 and 20 together, main section 18 is positioned on a flat surface, such as a mattress, with loop section 36 on top surface 30 of panel 16 facing upward. Main section 20 is positioned over main section 18 with both panels 16 of both main sections 18 and 20 aligned, and both foam members 12 positioned parallel to one another. Panel 16 of main section 20 is then lowered onto top surface 30 of panel 16 of main section 18, mating the corresponding hook and loop fastening strips 34 affixed together. Once attached, the combined main sections 18 and 20, or assembled support pillow 10, creates a channel 40 into which infant 42 is placed lengthwise on its side. Channel 40 is therefore defined by both vertical side walls 26 and at least one panel 16, leaving channel 40 with an open top surface 50 and two oppositely disposed open ends 52.

By being transversely affixed onto both panels 16, hook and loop fastening strips 34 allow adjustments in the width of channel 40. To narrow channel 40 or decrease the distance between the two adjacent vertical side walls 26 of both main sections 18 and 20, both panels 16 are separated, then panel 16 of main section 20 is folded longitudinally upward. This vertical folded portion of panel 16 is affixed onto looped sections 36 of hook and loop fastening strips 34 on vertical side wall 26 of main section 18. The remaining horizontal portion of panel 16 of main section 20 is affixed onto the top surface 30 of main section 18 and secured to the remaining corresponding portions of hook and loop fastening strips 34. This procedure is used to create a narrower channel 40 to accommodate the smaller infants 42 or newborns. Once infant 42 is placed in channel 40, through open top surface 50, strap 46 is then placed over infant 42 and connected to strap connector 48 to prevent infant 42 from slipping downward within channel 40 through open ends 52.

To accommodate larger infants 42, channel 40 is widened. To accomplish this, both panels 16 are separated and then reattached towards the distal lateral edges of both panels 16. Only a small portion of the ends of both mating sections 36 and 38 need to be affixed to provide sufficient contact to prevent both panels 16 from separating during normal use. Although widening channel 40 may leave a large portion of looped sections 36 of hook and loop fastening strips 34 exposed on the surface of vertical side wall 26 of main section 18, looped sections 36 are soft and will not be abrasive to infant 42 nor will they adhere to any surface other than hooked sections 38.

Although not shown, support pillow 10 can be provided with openable end walls 22, closeable with hook and loop fastening strips 34 or zippers, for an alternate method of removal of members 12. Fabric covering 14 can also be eliminated altogether from one or both end walls 22 for removal of members 12, eliminating the need and cost of pocket opening 44. With this embodiment however, foam members 12 would preferably be provided with a non-porous, water repellant outer covering, since both ends of foam members 12 would be exposed. This would make removal and re-insertion of foam members 12 easier and cleaning could include simple wiping with a detergent and or disinfectant, with the removed fabric covering 14 being separately machine washable and dryable. In another anticipated embodiment of the invention, fiber batting such as cotton, and paper are used to define member 12 and covering 14 respectively, and this embodiment is believed might be inexpensive enough to be considered to be disposable when the unit becomes soiled. This disposable embodiment would still utilize a strap 46 for securing the baby, and would still use hook and loop fasteners on the rectangular panels for attaching the main sections of the pillow adjustably together as with embodiment 10.

Although I have very specifically described a preferred structure of the invention, it should be understood that the specific details are just that, "preferred", and given only for example to those skilled in the art. Many changes in the specific structures described may be made without departing from the true scope of my invention as recited in the appended claims.

What I claim as my invention is:

1. A support pillow structured for maintaining a human on its side while sleeping, said support pillow comprising;

a first main section and a second main section, said first main section comprising an elongated flexible and resilient pad having at least a generally vertically disposed planar side wall connected to a substantially horizontally disposed generally flat base, a panel extending from and beyond an intersection of said vertically disposed planar side wall and said horizontally disposed base, said panel having a top surface and an oppositely disposed bottom surface, said top surface of said panel affixed with a first portion of a fastener means;

said second main section comprising an elongated flexible and resilient pad having at least a generally vertically disposed planar side wall connected to a substantially horizontally disposed generally flat base, a panel extending from and beyond an intersection of said vertically disposed planar side wall and said horizontally disposed base, said panel of said second main section having a top surface and an oppositely disposed bottom surface, said bottom surface of said panel of said second main section affixed with a second portion of fastener means releasably attached to said first portion of fastener means of said first main section with said panels of said first and second main sections overlapped, the overlapped panels in combination with said horizontally disposed generally flat bases of said first and second main sections providing a substantially flat anti-roll bottom on said support pillow, said support pillow including a channel having an open top and two oppositely disposed open ends, a bottom of said channel defined by the overlapped panels, said channel having oppositely disposed sides defined by said vertically disposed planar side walls of said first and second main sections positioned generally parallel to one another and further in spaced relationship to one another, the first and second portions of said fastener means further including means for allowing small increment adjustments in the spacing between the vertically disposed planar side walls and thus in the width of said channel.

2. A support pillow structured for maintaining a human on its side while sleeping, said support pillow comprising:

a first main section and a second main section, said first main section comprising an elongated flexible and resilient pad having at least a generally vertically disposed planar side wall connected to a substantially horizontally disposed generally flat base, a thin sheet extending from and beyond an intersection of said vertically disposed planar side wall and said horizontally disposed base to define a thin flexible panel, said panel having a top surface and an oppositely disposed bottom surface, said top surface of said panel affixed with at least one hook and loop fastening member;

said second main section comprising an elongated flexible and resilient pad having at least a generally vertically disposed planar side wall connected to a substantially horizontally disposed generally flat base, a thin sheet extending from and beyond an intersection of said vertically disposed planar side wall and said horizontally disposed base of said second main section to define a thin flexible panel, said panel of said second main section having a top surface and an oppositely disposed bottom surface, said bottom surface of said panel of said second main section affixed with at least one hook and loop fastening member releasably mated to said hook and loop fastening member of said first main section with said panels of said first and second main sections overlapped, the overlapped panels in combination with said horizontally disposed generally flat bases of said first and second main sections providing a substantially flat anti-roll bottom on said support pillow, said support pillow including a channel having an open top and two oppositely disposed open ends, a bottom of said channel defined by the overlapped panels, said channel having oppositely disposed sides defined by said vertically disposed planar side walls of said first and second main sections positioned generally parallel to one another and further in spaced relationship to one another, said hook and loop fasteners of the panels of said first and second main sections positioned and sized relative to one another and relative to the vertically disposed planar side walls so as to allow for small increment adjustments in the spacing between the vertically disposed planar side walls and thus in the width of said channel.

3. A support pillow structured for maintaining a human infant on its side while sleeping, said support pillow comprising;

a first main section and a second main section, said first main section comprising an elongated substantially right-triangular foam member of a flexible and resilient nature, said foam member wrapped within an outer fabric sheeting to define a resilient pad, said pad having at least a substantially vertically disposed side wall connected to a substantially horizontally disposed generally flat base, said fabric further extending from and beyond an intersection of said vertically disposed side wall and said horizontally disposed base to define a substantially flat rectangular panel, said rectangular panel having a top surface and an oppositely disposed bottom surface, said top surface of said rectangular panel affixed with at least one hook and loop fastening member, said fabric wrapping said foam member having means for allowing removal of said foam member from said fabric, said second main section comprising an elongated substantially right-triangular foam member of a flexible and resilient nature, said foam member of said second main section wrapped within an outer fabric sheeting to define a resilient pad, said pad of said second main section having at least a substantially vertically disposed side wall connected to a substantially horizontally disposed generally flat base, said fabric of said second main section further extending from and beyond an intersection of said vertically disposed side wall and said horizontally disposed base of said second main section to define a substantially flat rectangular panel, said fabric wrapping said foam member of said second main section having means for allowing removal of said foam member from said fabric, said rectangular panel of said second main section having a top surface and an oppositely disposed bottom surface, said bottom surface of said rectangular panel of said second main section affixed with at least one hook and loop fastening member releasibly mated to said hook and loop fastening member of said first main section with said rectangular panels of said first and second main sections overlapped, the overlapped rectangular panels in combination with said horizontally disposed generally flat bases of said first and second main sections providing a substantially flat anti-roll bottom on said support pillow, said support pillow including a channel having an open top and two oppositely disposed open ends, a bottom of said channel defined by the overlapped rectangular panels, said channel having oppositely disposed sides defined by said vertically disposed side walls of said first and second main sections positioned generally parallel to one another and further in spaced relationship to one another, said hook and loop fasteners of the rectangular panels of said first and second main sections positioned and sized relative to one another and relative to the vertically disposed side walls so as to allow for small increment adjustments in the spacing between the vertically disposed side walls and thus in the width of said channel, at least one flexible elongated strap affixed to said first main section and said second main section and spanning across said channel, the affixment of said strap including means for releasably and adjustably affixing at least one end of said strap to one of the main sections of said support pillow.

4. A support pillow structured for maintaining a human infant on its side while sleeping in accordance with claim 3 wherein the affixment of said strap including means for releasably and adjustably affixing at least one end of said strap to one of the main sections of said support pillow includes the use of hook and loop fastener.

5. A support pillow structured for maintaining a human infant on its side while sleeping in accordance with claim 4 wherein said fabric is terry-cloth.

* * * * *